United States Patent [19]

Zimmerman

[11] Patent Number: 4,666,017

[45] Date of Patent: May 19, 1987

[54] INFANT HARNESS OR THE LIKE

[75] Inventor: Donald A. Zimmerman, Sanford, N.C.

[73] Assignee: Tot-Safe, Inc., Sanford, N.C.

[21] Appl. No.: 904,611

[22] Filed: Sep. 8, 1986

[51] Int. Cl.[4] ..... A62B 35/00; A63B 69/00

[52] U.S. Cl. ..... 182/3; 441/80; 119/96

[58] Field of Search ..... 182/3, 4, 5, 6, 7, 8; 119/96; 441/80

[56] References Cited

U.S. PATENT DOCUMENTS

| | | | |
|---|---|---|---|
| 1,409,702 | 3/1922 | Gill | 182/3 |
| 1,967,767 | 7/1934 | Diez | 182/3 |
| 2,344,031 | 3/1944 | Shano | 182/6 |
| 2,413,395 | 12/1946 | Ware | 182/3 |
| 2,449,741 | 9/1948 | Fitzpatrick | 182/5 |
| 2,758,769 | 8/1956 | Nunn | 182/3 |
| 2,817,393 | 12/1957 | Mitchell | 182/3 |
| 3,301,594 | 1/1967 | Pukish | 182/3 |
| 4,308,629 | 1/1982 | Freeman | 182/3 |

*Primary Examiner*—Reinaldo P. Machado
*Attorney, Agent, or Firm*—Mills & Coats

[57] ABSTRACT

A child safety harness is provided having a waistband, a backpiece, a pair of shoulder straps and a tether. The shoulder straps are secured at one end to the waistband and at the opposite end to the backpiece. When fitting the safety harness on a child the waistband is extended around the waist so that its free ends are behind the child. The shoulder straps are pulled over the shoulders and downwardly across the back so that the back piece is in alignment with the waistband. The free ends of the waistband can then be releasably secured to the backpiece effectively securing the child safety harness on the child.

7 Claims, 4 Drawing Figures

INFANT HARNESS OR THE LIKE

FIELD OF THE INVENTION

The present invention relates generally to restraining devices and more particularly to child safety harnesses.

BACKGROUND OF THE INVENTION

The problem of controlling and managing a young, inquisitive child has long plagued parents. The problem is particularly acute when it is necessary to take the child into some crowded public place and/or high traffic areas such as a shopping centers, department store, amusement park, airports, etc. It is not always possible to hold, carry or keep a watchful eye over young children when other endeavors require the attention of the parent or other adult. At these times, children are apt to wander or run away from the parent and become lost in a crowd or even worse run into vehicle traffic areas.

In order to safeguard children and to prevent them from becoming lost and/or injured, child safety harnesses have been used which give the parent control over the child without requiring their undivided attention. Some disadvantages associated with prior art safety harnesses include difficulty in getting into or out of the device, uncomfortable fit, shoulder strap slippage, child can release himself because of poor design, cost, weight of harness and lack of means for adjustment. For these reasons and others, child safety harnesses are not yet widely used.

SUMMARY AND OBJECT OF THE INVENTION

After much research and study into the foregoing problems, the present invention was developed to provide a secure, but comfortable child safety harness which overcomes the disadvantages of prior art harnesses. More particularly, the child safety harness of the present invention includes a relatively wide waistband, a backpiece, a pair of shoulder straps secured at one end to the waistband and at the opposite end to the backpiece, and a tether. In fitting the child safety harness on a child, the waistband is placed adjacent the child's waist and the shoulder straps are extended over the child's shoulders and pulled down across the back so that the backpiece is in alignment with the free ends of the waistband. The free ends of the waistband are then releasably secured to the backpiece by means of a hook and loop type fastener which permits adjustment of the waistband. Likewise, means are provided for adjusting the length of the shoulder straps.

In view of the above, it is a object of the present invention to provide a child safety harness which will give parents control over their children while at the same time giving the child comfortable freedom for movement.

Another object of the present invention is to provide a child safety harness that is lightweight and can be comfortably worn by the child.

Another object of the present invention is to provide a child safety harness that is fully adjustable so that one size fits all children and so that the safety harness fits over both summer and winter clothing.

Another object of the present invention is to provide a child safety harness which can be easily and quickly fitted onto the child.

Another object of the present invention is to provide a child safety harness having a durable, one piece construction.

Another object of the present invention is to provide a child safety harness that is highly visible.

Another object of the present invention is to provide a child safety harness that is relatively inexpensive to manufac- ture.

Other objects and advantages of the present invention will become apparent and obvious from a study of the following description and the accompanying drawings which are merely illustrative of such invention.

DETAILED DESCRIPTION OF THE INVENTION

With further reference to the drawings, the child safety harness of the present invention is shown therein and indicated generally by the numeral 10. The child safety harness 10 includes a waistband indicated at 11, a backpiece indicated generally at 12, a pair of shoulder straps indicated at 13, and a tether indicated at 14.

Figure 2:
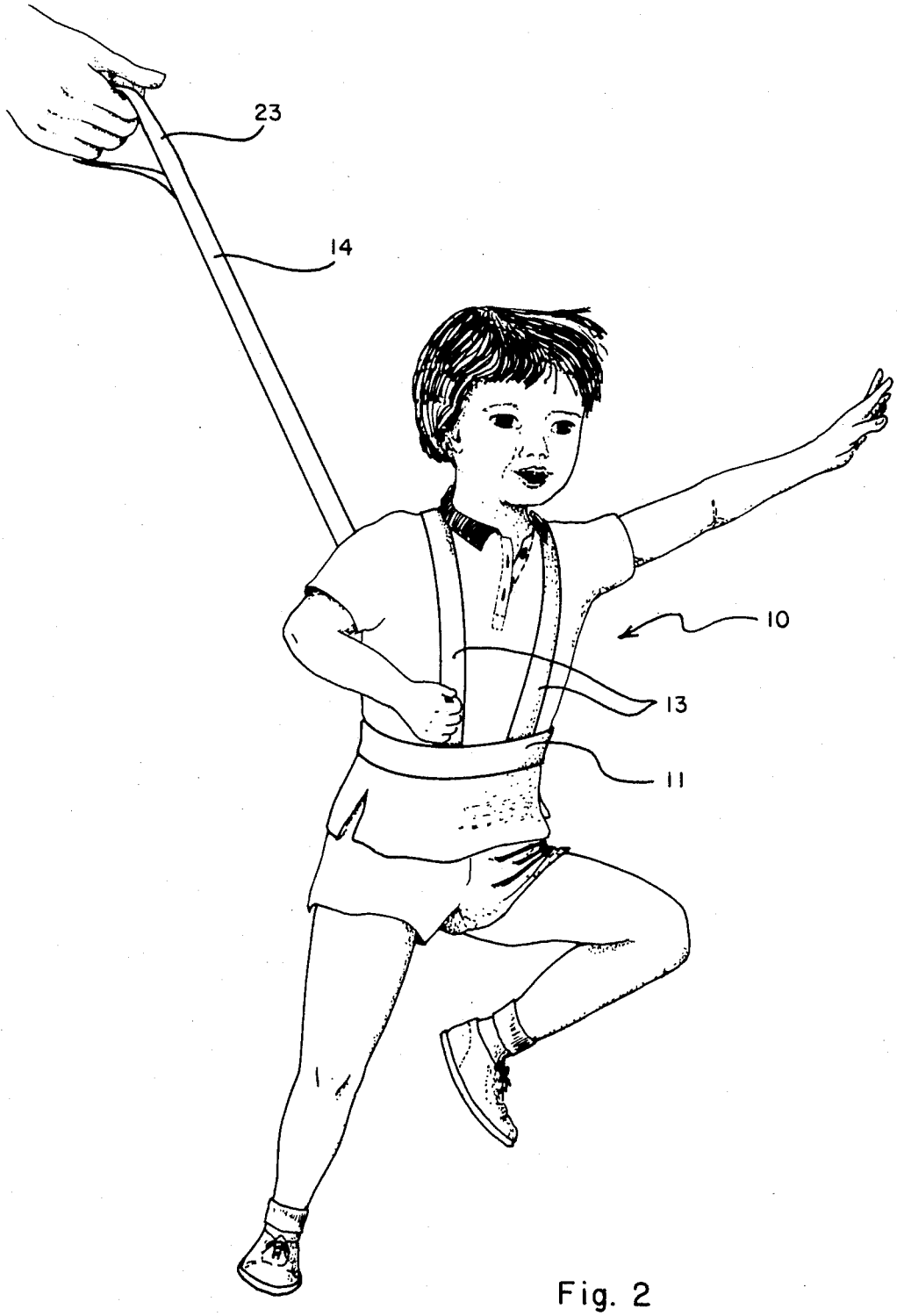
FIG. 2 is a front perspective view of a child wearing the child safety harness of the present invention.

The waistband 11 is constructed of a single relatively wide strap and includes a pair of free ends 15. A fabric hook and loop type fastener 16 is secured to each free end 15 of the waistband 11 as can be clearly seen in FIG. 2.

The backpiece 12 has a generally T-shaped configuration and includes a fastening strap 17 for securing the free ends 15 of waistband 11 and a securing strap 18 for securing the shoulder straps 13 as will be hereinafter described in greater detail. A fabric hook and loop type fastener 19 is secured to the fastening strap 17 and covers substantially the entire surface thereof. It is apparent, therefore, that the free ends 15 of waistband 11 can be secured to the fastening strap 17 by pressing the hook and loop type fasteners 16 of waistband 11 against the hook and loop type fastener 19 of backpiece 12.

Figure 3:
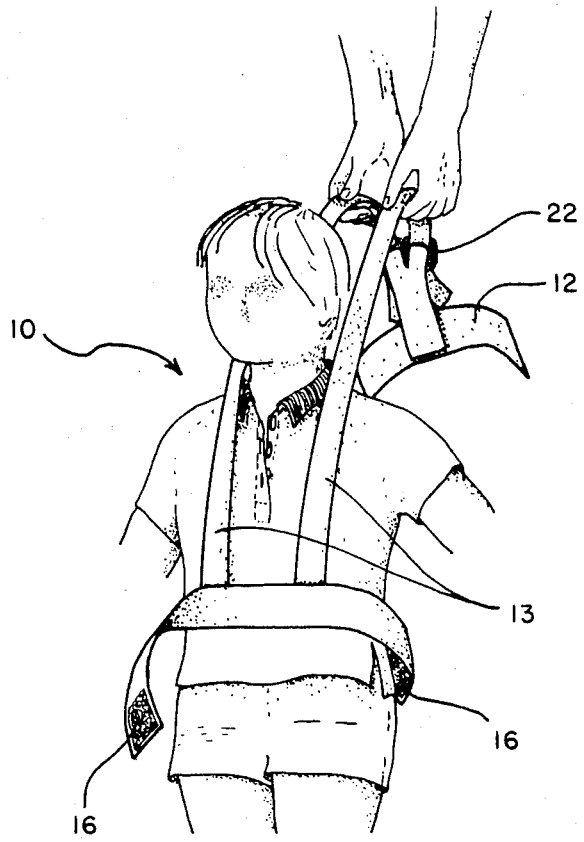
FIG. 3 is a front perspective view of a child being fitted with the child safety harness of the present invention.
Figure 4:
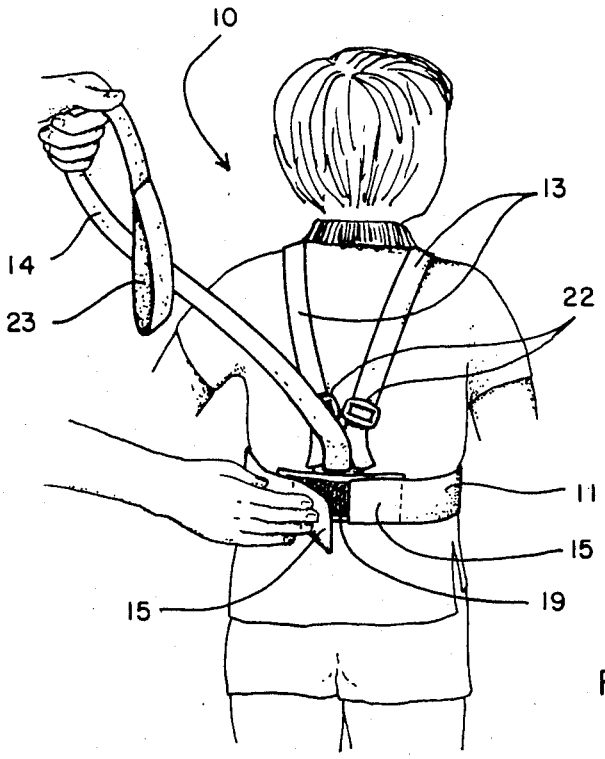
FIG. 4 is a rear perspective view of a child being fitted with the child safety harness of the present invention.

The securing strap 18 is secured at one end to the fastening straps 17 and has a pair of fabric loops 20 secured to the opposite end thereof. (FIG. 3) Interlocked with the fabric loops 20 are a pair of elongated rings 21 whose purpose will hereinafter become apparent.

Figure 1:
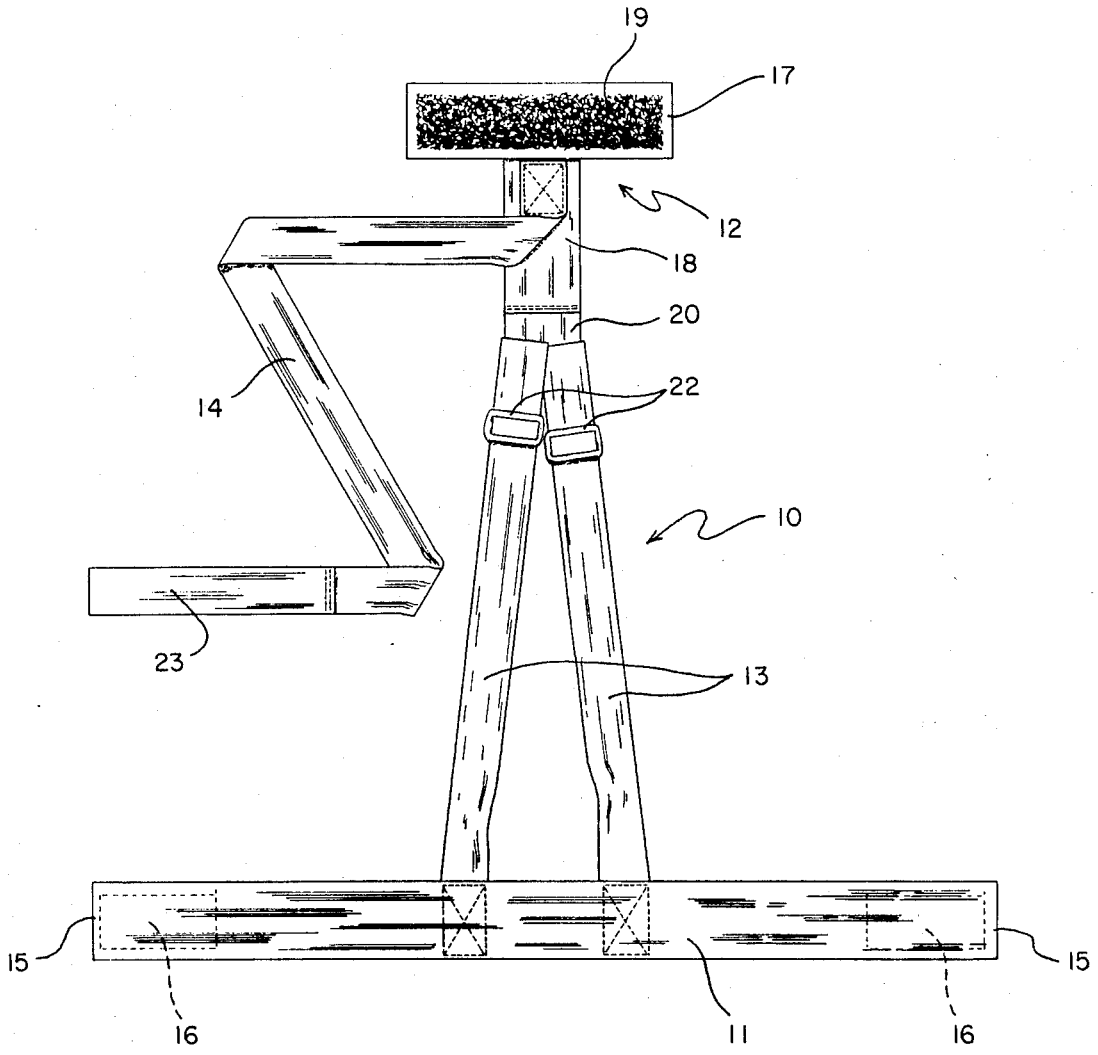
FIG. 1 is a plan view of the child safety harness of the present invention.

The shoulder straps 13 extend between and interconnect the waistband 11 with the backpiece 12. More particularly, the shoulder straps 13 are secured at one end to the waistband 11 as shown in FIG. 1. The opposite end of the shoulder straps 13 extend through respective rings 21 and are doubled-back and secured by a buckle 22. It is understood that this arrangement allows the length of the shoulder straps to be adjusted depending upon the size of the child.

The tether 14 is formed from a single relatively wide strap approximately 36 inches in length. The tether is secured at one end to the backpiece 12 and has a hand loop 23 formed at the opposite end thereof.

The waistband 11, backpiece 12, shoulder straps 13, and tether 14 can be constructed from any durable fabric material such as a sturdy polypropylene webbing and can be fastened together by sewing the same with a relatively heavy nylon thread. The webbing material used should be any highly visible color which should be colorfast and non-toxic.

To use the child safety harness of the present invention, the wasitband 11 is placed around the child's waist such that the free ends extends to the small of the back. The shoulder straps 13 are then pulled over the child's shoulders and across the child's back so that the backpiece 12 is in alignment with the waistband 11. The free ends 15 of the waistband 11 are then secured to the backpiece 12 by pressing the hook and loop type fastners 16 thereof against the corresponding hook and loop type fastner 19 on backpiece 12. When fastening the waistband 11 the same should be pulled slightly to assure a snug but comfortable fit about the waist of the child. Once the safety harness 10 is fitted on the child the length of the shoulder straps 13 can also be adjusted as needed.

The child safety harness 10 of the present invention provides a parent with means for maintaining control over the child while at the same time providing the child with some whereabouts of the child. The hands of the parent can also be free by simply inserting an arm into the loop 23 without sacrificing any control over the child.

The relatively wide waistband and shoulder straps provide a more comfortable safety harness from the point of view of the child. Additionally, the unique design virtually eliminates the annoying problem of the shoulder straps slipping by having the straps converge at the backpiece 12.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A child safety harness comprising: a waistband having two free ends; a backpiece for receiving and securing the free ends of said waistband so as to secure the same about the waist of a child; means for securing the free ends of said waistband to said backpiece; a pair of shoulder straps adapted to extend over the shoulders of a child secured at one end to said waistband and at the opposite end to said backpiece; and a tether secured at one end to said backpiece whereby means are provided for controlling the child while at the same time allowing the child a comfortable range of movement.

2. The child safety harness of claim 1 wherein said securing means is a hook and loop type fastener.

3. The child safety harness of claim 1 further including means for adjusting the length of the shoulder straps.

4. The child safety harness of claim 1 wherein said tether has a loop formed in the end opposite the end secured to said backpiece.

5. The child safety harness of claim 1 wherein said shoulder straps are spaced apart at said waistband and converge towards said backpiece.

6. The child safety harness of claim 1 wherein said waistband, shoulder straps, backpiece, and tether are constructed by a highly visible webbing-type material.

7. The child safety harness of claim 6 wherein said webbing-type material is a polypropylene webbing.

* * * * *